US006276006B1

(12) United States Patent
Hoit

(10) Patent No.: US 6,276,006 B1
(45) Date of Patent: Aug. 21, 2001

(54) SLING FOR TRANSPORTING A PERSON INTO A CHAIR AND METHOD OF USING THE SAME

(76) Inventor: Judy Hoit, 1337 Burns Ave., Iowa City, IA (US) 52240

( * ) Notice: Subject to any disclaimer, the term of this patent is extended or adjusted under 35 U.S.C. 154(b) by 0 days.

(21) Appl. No.: 09/416,795

(22) Filed: Oct. 13, 1999

(51) Int. Cl.[7] ..... A61G 7/08
(52) U.S. Cl. ..... 5/81.1 R; 5/81.1 T
(58) Field of Search ..... 244/122 R; 5/81.1 T, 5/81.1 R, 86.1, 89.1; 294/140; 119/770; 224/159

(56) References Cited

U.S. PATENT DOCUMENTS 1,035,642 * 8/1912 Rosse .
4,553,633 * 11/1985 Armstrong et al. ..... 182/3
4,580,372 * 4/1986 Osborn ..... 52/3
4,723,327 * 2/1988 Smith ..... 5/82 R
4,981,307 * 1/1991 Walsh ..... 280/290
5,297,834 * 3/1994 Vanarnem ..... 294/140
5,388,551 * 2/1995 Martusciello ..... 119/770
5,579,546 * 12/1996 Griskauskas ..... 5/81.1 T
6,122,778 * 9/2000 Cohen ..... 5/81.1 R
6,154,899 * 12/2000 Brooke et al. ..... 5/81.1 R

* cited by examiner

*Primary Examiner*—Charles T. Jordan
*Assistant Examiner*—Christian M. Best
(74) *Attorney, Agent, or Firm*—Simmons, Perrine, Albright & Ellwood PLC

(57) ABSTRACT

An apparatus and method for moving an airline passenger whereby a Tyvek® sling having handles attached thereto is buckled about an airline passenger and then the passenger is lifted and transferred, by two or more persons grasping the handles, from a wheelchair on the aircraft into an adjacent seat.

3 Claims, 4 Drawing Sheets

SLING FOR TRANSPORTING A PERSON INTO A CHAIR AND METHOD OF USING THE SAME

FIELD OF THE INVENTION

The present invention generally relates to slings for lifting people, and more particularly relates to portable hand-operated slings and methods of using the same.

BACKGROUND OF THE INVENTION

In the past years, persons with disabilities have often struggled considerably when they travel, especially via commercial air transport airlines. Typically, a passenger with a disability is moved from their own wheelchair to an "aisle chair", which is a specially designed wheelchair to be used in the narrow aisles of an airliner. The passenger is then wheeled to the appropriate row of seats in the aircraft. At this point, the flight attendants, or others on the aircraft, will typically assist in moving the passenger to the assigned seat. This is typically accomplished by having one or more persons grab a leg or legs of the passenger while another lifts under the arms. While this approach has been successfully used countless times to move passengers, it does have several drawbacks.

First of all, the process usually requires physical touching of the passenger's thighs, knees and underarms. To the passenger, this can be an unpleasant and intrusive procedure. Similarly, it often creates anxiety in the flight attendants, who normally are reluctant to physically touch the thighs and underarms of their passengers. These techniques are especially problematic when the passenger has very weak muscles in the thighs, upper arm and shoulder area, as is often the case with polio survivors.

This process is repeated each time the passenger is moved to and from the assigned seat, such as when loading and unloading the aircraft, as well as when the passenger needs to use the restroom on the aircraft.

Consequently, there exists a need for improved systems and methods of moving a passenger with a disability to and from a seated position.

SUMMARY OF THE INVENTION

It is an object of the present invention to provide a hand-operated portable sling system.

It is a feature of the present invention to include a thin light-weight sling in combination with a plurality of handles and/or buckles.

It is an advantage of the present invention to eliminate the need for physically touching the thighs and underarms of the passenger.

It is another object of the present invention to provide an in-flight system for moving a passenger about the cabin, without the need for a full aisle wheelchair.

It is a feature of the present invention to use a handled sling to move the passenger to the on-board restroom.

It is another advantage of the present invention to dramatically reduce the weight of on-board equipment for moving passengers about the cabin.

The present invention is an apparatus and method for transporting a passenger from a first seated position in an aircraft to a second seated position in the aircraft, which is designed to satisfy the aforementioned needs, produce the previously stated objects, include the above-listed features, and achieve the already articulated advantages.

Accordingly, the present invention is a portable hand-operated sling and method of use of the same for lifting a passenger from one seated position to another in an aircraft.

BRIEF DESCRIPTION OF THE DRAWINGS

The present invention may be more fully understood by reading the following description of the preferred embodiments of the invention in conjunction with the appended drawings wherein.

DETAILED DESCRIPTION

Figure 1:
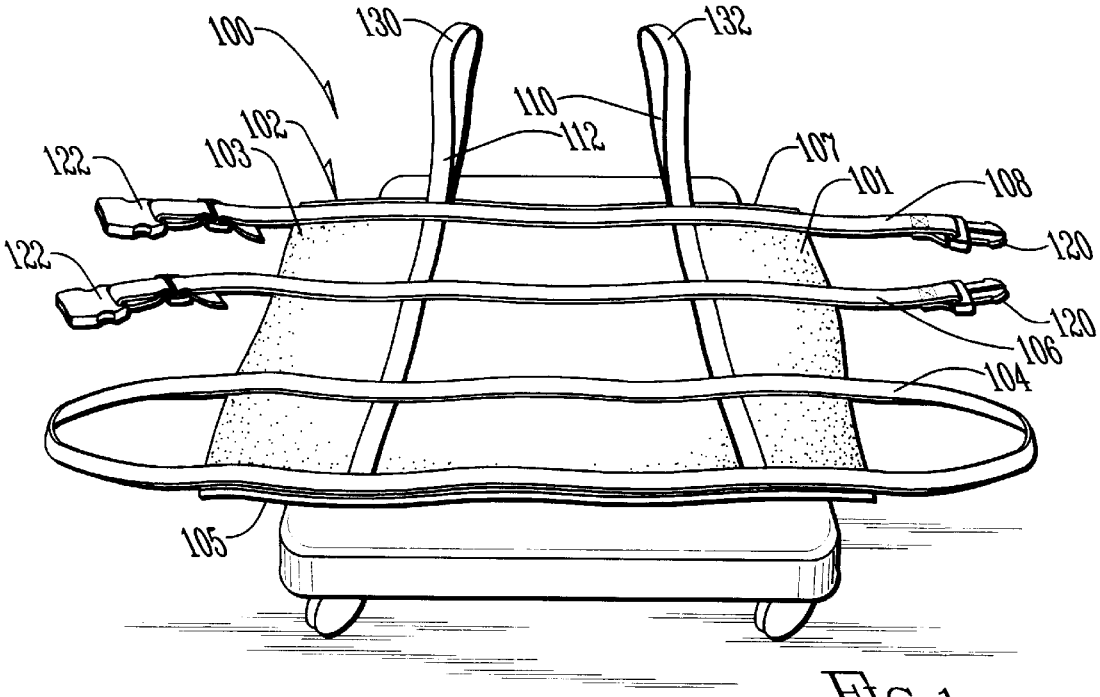
FIG. 1 is a view of the passenger side of the apparatus of the present invention.

Now referring to the drawings, wherein like numerals refer to like matter throughout, and more particularly to FIG. 1, there is shown a sling of the present invention, generally designated 100, including a flexible sling panel 102, which is preferably made of spunbonded high-density polyethylene (HDPE), such as Tyvek® spunbonded olefin which is manufactured by Dupont Corporation, from very fine continuous filaments of high-density polyethylene (HDPE) bonded together by heat and pressure. Tyvek® spunbonded olefin is chemically inert, naturally white and contains no binders or fillers. Flexible sling panel 102 has a right side 101, left side 103, front side 105 and back side 107. Disposed on panel 102 is leg strap loop 104, which is shown as a loop of nylon or other durable strap material which extends inwardly from said front side 105 and outwardly beyond right side 101 and left side 103. The portions of loop 104 which extend outwardly from right side 101 and left side 103 are used as handles to support the weight of the passenger. Sling 100 also includes a lower sling fastener strap 106 and an upper sling fastener strap 108. Straps 106 and 108 preferably are used to secure the sling around the torso of the passenger. Buckles or latch mechanisms which are well known in the art can be used to accomplish a secure fit. Male buckle 120 and female buckle 122 are shown on opposite ends of strap 108. Strap 106 preferably has similar buckling capabilities. These buckles preferably are adjustable in length in position along strap 108 to accommodate varying sized individuals. Sling 100 also is shown having a left support strap 110 which is formed into a left stabilizing handle 132 and a right support strap 112, which is similarly formed into a right stabilizing handle 130. Handles 130 and 132 may be any material or devices which allow a person to grasp the same and thereby lift and primarily stabilize a passenger during use of the sling 100. The strap material used in the present invention may be any suitable strap material with sufficient tensile strength, flexibility and durability characteristics. Numerous such materials are well known in the art.

Figure 2:
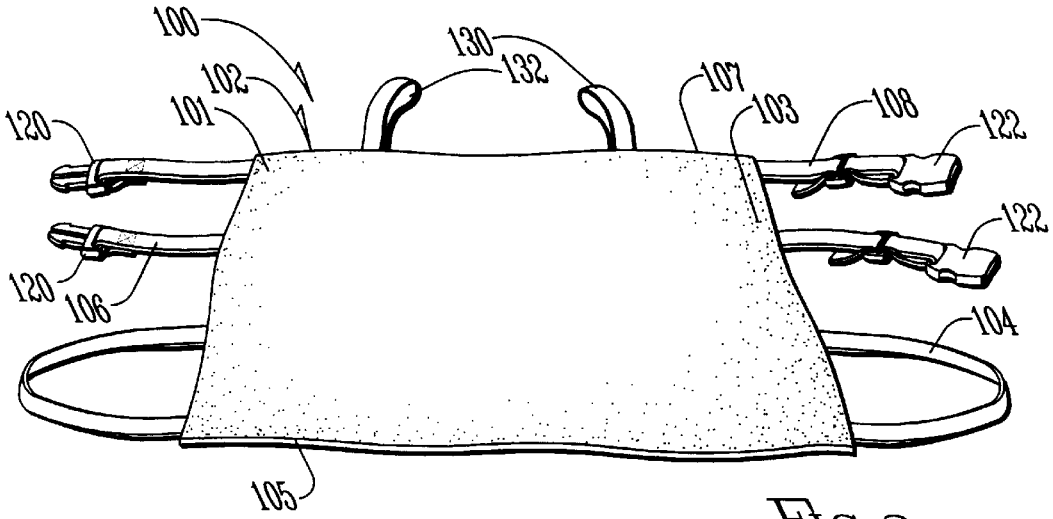
FIG. 2 is an opposite side view of the apparatus of FIG. 1.

Now referring to FIG. 2, there is shown an opposite side of sling 100 of FIG. 1.

Figure 3:
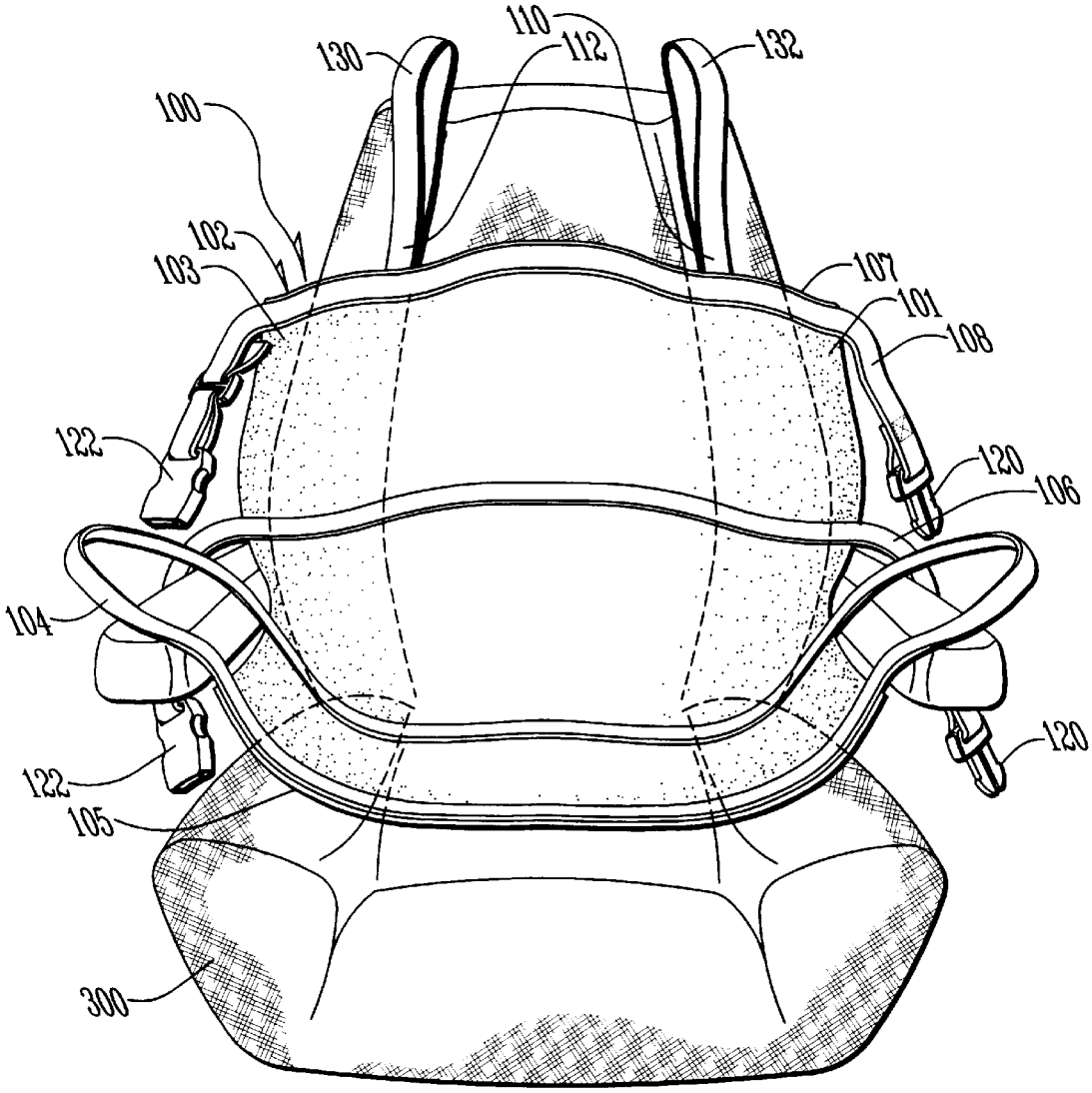
FIG. 3 is a view of the apparatus of FIG. 1 disposed in a chair.

Now referring to FIG. 3, there is shown a sling 100 draped over a chair 300, prior to securing the sling to the passenger.

Figure 4:
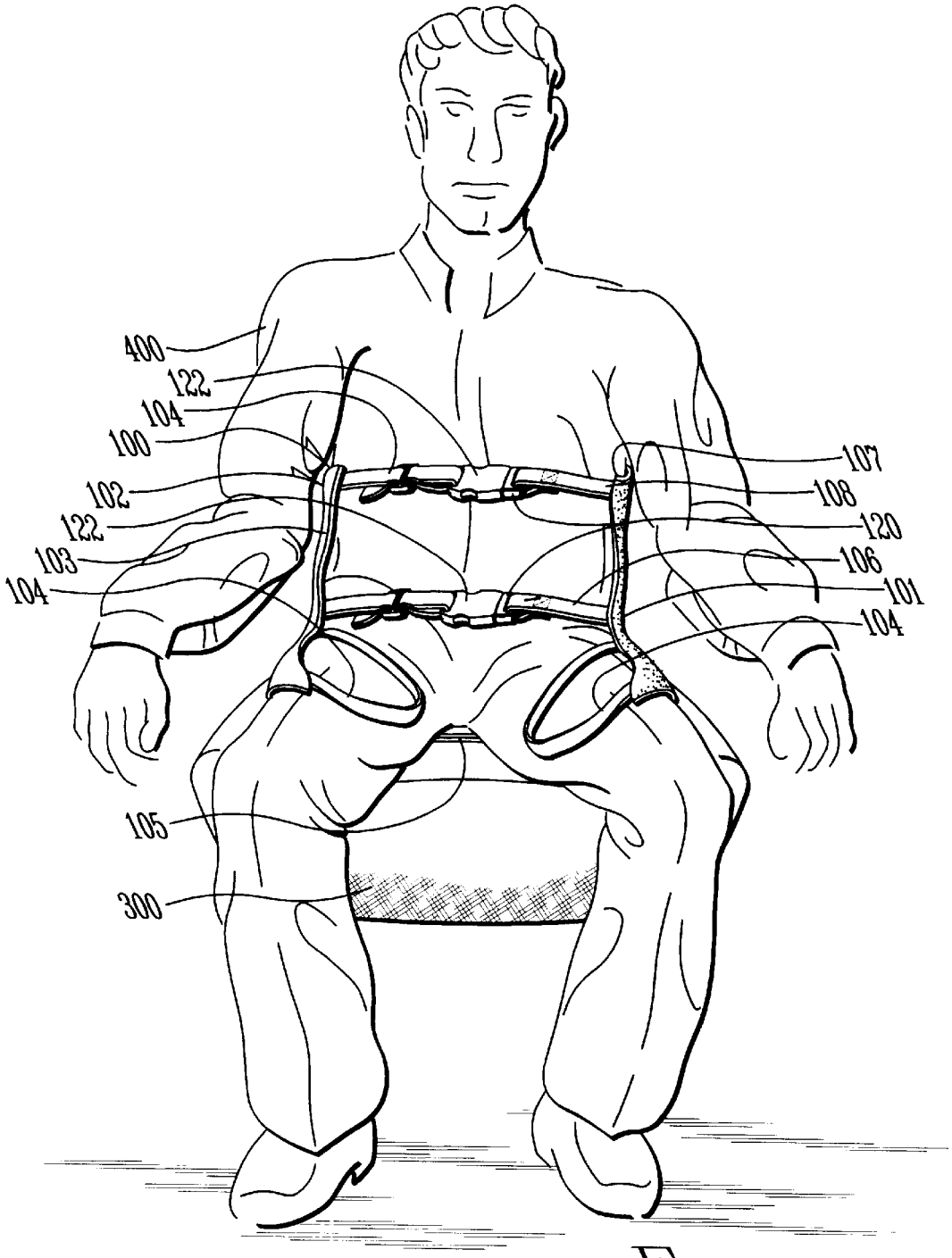
FIG. 4 is a view of the apparatus of FIG. 3 with a person seated in the chair and having the apparatus buckled.

Now referring to FIG. 4, there is shown a sling 100 secured to a passenger 400. Buckles 120 and 122 are shown mated and adjusted to secure the sling 100 to the torso of the passenger 100.

Figure 5:
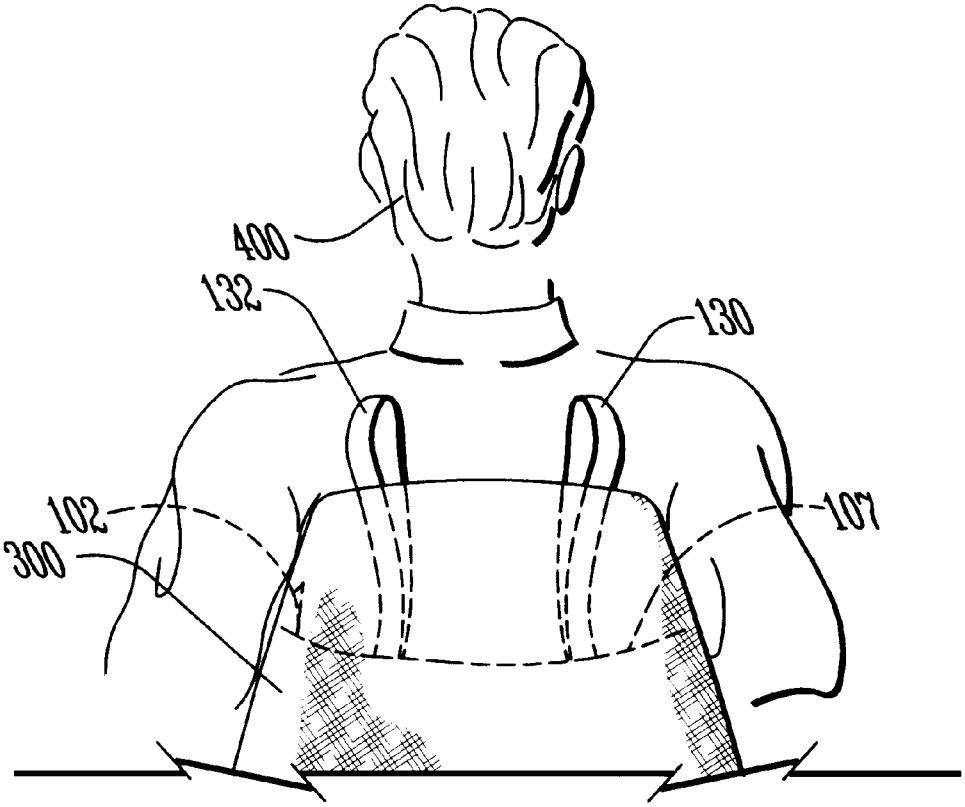
FIG. 5 is a view of the combination of the passenger and apparatus of the present invention of FIG. 4, from a rear viewpoint.

Now referring to FIG. 5, there is shown a rear view of the sling 100 of FIG. 4. The handles 130 and 132 are shown disposed in their normal operating position.

Now referring to the Figures, the operation of the present invention is as follows:

The sling 100 is placed in a chair 300. Chair 300 is shown as a stationary chair; however, it may often be a wheelchair. The passenger sits in the chair 300, and the sling is secured about the passenger's torso by buckling buckles 120 and 122, as well as any other buckles or fasteners that may be used for other straps, etc. This securing of the sling 100 to the passenger may occur at the passenger's home before any traveling occurs. Due to the properties of the materials used, the sling may be worn comfortably for extended time periods. Once the passenger has the sling secured and is seated in the chair 300, the passenger can be wheeled to the airport gate area. Upon arrival at the gate, the passenger 400 will typically need to be transferred to an aisle chair. With the aid of the sling 100, this can be accomplished with much improved ease and comfort. Depending upon the weight of the passenger, either one or two persons will grasp the loop 104 and lift the passenger from the chair 300. A second person can grasp handles 130 and 132 and lift as well. However, the sling 100 is designed such that most of the weight of the passenger is carried by the loop 104, and the handles 130 and 132 are used primarily for stabilizing the passenger. Once the passenger is lifted from the chair 300, the passenger can be transferred to the aisle chair and lowered. The passenger may continue to wear the sling throughout the flight. Once the passenger is in the aisle chair, it is wheeled to the passenger's assigned seat on the aircraft, and the process is repeated to transfer the passenger from the aisle chair to the aircraft seat. The process is repeated during any necessary trips to the aircraft restroom and upon departure from the aircraft.

In certain situations where weight and/or space constraints on-board the aircraft are serious concerns, it is conceivable that an aisle chair may not be carried on the aircraft. In such situations, the sling 100 may be used to transport the passenger to a nearby aircraft restroom, etc. if necessary. In such situations, it may be desired to have handles 130 and 132 to be adjustable in length or to have multiple handles available. The passenger can be lifted from the seat and moved along the aisle to the restroom. Longer loops 104 or multiple or adjustably positioned handles 130 and 132 may allow the passenger to be carried along at a reduced height above the floor, to prevent injury to the passenger in the event of being accidentally dropped. While it may add weight to the aircraft, it is conceivable that a small low profile multi-wheeled board or cart may be used to transfer the passenger down the aisle. This approach will likely not be as comfortable for the passenger, as a full aisle chair, but in situations where an aisle chair is unavailable, it may be preferred to the often only other alternative of remaining seated during the entire flight. The board preferably would be small enough to be carried by the passenger as carry-on baggage.

Throughout the description herein, the present invention is described as for use on an aircraft, because it is believed that the beneficial aspects of the present invention will be most readily apparent when considered in such an environment. However, the present invention is not intended to be limited solely to use on aircraft. It may be used on trains, boats and automobiles etc. Aviation is merely believed to be one of the most preferred uses of the invention. The extremely low weight and size characteristics of the present invention are likely to be most important in the aviation environment.

It is thought that the apparatus of the present invention will be understood from the foregoing description, and it will be apparent that various changes may be made in the form, construction, and arrangement of the parts thereof without departing from the spirit and scope of the invention or sacrificing all of its material advantages, the form herein described being merely a preferred or exemplary embodiment thereof.

I claim:

1. A sling apparatus for moving a person from one seated position to another seated position, the sling comprising:

a rectangular flexible panel, having a front side, a right side, a left side, a back side and an intermediate point centrally disposed therein;

a sling closure device adapted to secure the flexible panel around a torso of a person;

a plurality of front handles disposed forward of said intermediate point for use in lifting a person enclosed in said flexible panel;

a plurality of back handles disposed rearward of said intermediate point;

wherein said flexible panel is a spunbonded high-density polyethylene (HDPE) material;

wherein said sling closure device comprises a flexible strap and a buckle, which buckle is capable of adjustment to permit a secure attachment of the sling to a torso of a person;

wherein said plurality of front handles includes a handle on the right side and a handle on the left side;

wherein said plurality of back handles includes a first back stabilizing handle disposed to the right of said intermediate point and a second back stabilizing handle disposed to the left of said intermediate point;

wherein said plurality of front handles are formed by a loop of a strap extending across and beyond said flexible panel;

wherein said sling closure device is a chest sling closure device and further comprising a lap sling closure device;

wherein said first back stabilizing handle is attached at a single point along said back side;

wherein said second back stabilizing handle is attached at a single point along said back side; and wherein each of said plurality of back handles is coupled to a single elongated strap extending from said front side to said back side.

2. A sling of claim 1 wherein said first back handle is formed by a loop of a strap extending from said front side to said back side and beyond.

3. A process of transferring a first person from a first seated position to a second seated position comprising the steps of:

providing a sling having a plurality of front handles and a plurality of back handles, said sling having a securing means adapted for securing the sling about a torso of a person;

securing the sling which is adapted to be secured to a person;

causing said sling to be at a location adjacent to said second seated position;

using at least one of the plurality of front handles which is adapted for manually grasping;

using at least one of the plurality of rear handles, which is attached at a single point along the back side and adapted for manually grasping.

lifting said sling by simultaneously applying upwardly directed force to said plurality of front handles and said plurality of back handles;

moving said sling laterally over said second seated position;

lowering said sling;

wherein said sling is lowered onto a wheeled board; and wherein said wheeled board has a predetermined size characteristic which is smaller than a maximum predetermined size for carrying on-board a predetermined aircraft.

* * * * *